US005578982A

United States Patent [19]

Serigny

[11] Patent Number: 5,578,982

[45] Date of Patent: Nov. 26, 1996

[54] TEMPERATURE LIMITERS

[75] Inventor: Jean Serigny, La Tronche, France

[73] Assignee: Cotherm, Vinay, France

[21] Appl. No.: 371,770

[22] Filed: Jan. 11, 1995

[30] Foreign Application Priority Data

Jan. 14, 1994 [FR] France ..... 94 00564
Jun. 10, 1994 [FR] France ..... 94 07342

[51] Int. Cl.[6] ..... H01H 37/00

[52] U.S. Cl. ..... 337/298; 337/300

[58] Field of Search ..... 337/298, 299, 337/300, 303, 304, 308, 311

[56] References Cited

U.S. PATENT DOCUMENTS 4,288,770 9/1981 Gillette ..... 337/173
4,878,038 10/1989 Tsai ..... 337/107

FOREIGN PATENT DOCUMENTS 1204872 1/1960 France .
3543562A1 6/1987 Germany .

*Primary Examiner*—Lincoln Donovan
*Attorney, Agent, or Firm*—Dowell & Dowell

[57] ABSTRACT

The temperature limiter comprises a ceramic box (3) communicating with at least one ceramic tube (1) which comprises a pellet (2) of alloy with determined Curie temperature, a magnet (6) fast with a plunger (7) comprising adjustment means (7*a*, 7*b*, 8) for recovering the functional clearances, said means cooperating inside the box (3) with an elastic blade (5) stressed so as to perform the role of a return spring to exert a force of pressure capable of controlling opening and closure of the contacts (4*a*, 5*a*).

14 Claims, 3 Drawing Sheets

TEMPERATURE LIMITERS

BACKGROUND OF INVENTION

Field of Invention

The present invention relates to improvements in temperature limiters intended to ensure safety of any heating system and in particular of a halogen and/or radiant cooking element whose heating power is regulated by an energy measurer or by any other system, as it is in that case that its application appears to present the greatest interest.

French Patent 1 204 872 describes an alarm device for thermal engine based on the sudden variation of the magnetic permeability (Curie point) of a pellet made of an alloy of appropriate composition and which cooperates with an elastically biased movable element in combination with a magnet so as to control opening of the contacts of an electric circuit. The temperature limiter according to the French Patent mentioned above presents a major drawback concerning the nature of the materials used. In fact, the tube containing the movable element is made of stainless steel, so that its expansion is detrimental to the precise release of the apparatus at the desired temperature. In fact, the greater the distance between the magnet and the pellet of metal alloy, the more the force of attraction decreases, so that the magnet is released more rapidly from the pellet. This results in a reduction in the rapidity of release and re-locking, as the force of the spring approaches the force of attraction between the magnet and the pellet. Moreover, the stainless steel tube does not guarantee electrical insulation between the metal parts and the live cooking element.

The device according to the French Patent in question presents a second drawback in that the magnet is placed at the end of the device, therefore at the spot where the temperature is the highest. Now, the limit of use of permanent magnets best resisting temperature is of the order of 500° C. Therefore, under these conditions, the magnet will rapidly lose its magnetic permeability, therefore its force of attraction. Finally, the device according to French Patent 1 204 872 is a safety device and not a temperature limiter which must function a large number of times around the temperature limit.

Limiters are also known which are in the form of a probe disposed in the vicinity of lamps or resistors and which are constituted by two elements, a glass tube which virtually does not dilate and a metal rod dilating inside the tube. The relative position of the two elements must be adjusted in order to obtain release at the correct temperature, which process is long and expensive. Moreover, the product is fragile.

SUMMARY OF THE INVENTION

The improvements forming the subject matter of the present invention aim at overcoming the drawbacks set forth hereinabove and at allowing a temperature limiter to be produced which responds better than heretofore to the desiderata of the art, in particular when it is associated with a halogen and/or radiant cooking element so as to protect the vitro-ceramic plate disposed above element for receiving the cooking utensils.

To that end, the temperature limiter according to the invention comprises a ceramic box communicating with at least one ceramic tube which includes a pellet of alloy with determined Curie temperature, a magnet secured to a plunger, which has adjustment means for recovering the functional clearances. The adjustment means cooperates inside the box with am elastic blade stressed so as to perform the role of a return spring to exert a force of pressure capable of controlling opening and closure of contacts belonging to an electric circuit.

In a varied the temperature limiter may further comprise means for controlling opening and closure of a signalling circuit so that the latter is open in the range of temperature included between 0° and 50° to 60° C. and closed between this temperature zone and the temperature of opening of the principal circuit in order, in that case, to activate a signalling lamp.

The limiter according to the invention is provided to replace those employing the principle of differential expansion which are very fragile and, cumbersome due to the materials used (quartz tube).

Moreover, the limiter according to the invention is more versatile due to its short tube which is adapted to cooking elements of different diameters.

BRIEF DESCRIPTION OF THE DRAWINGS

The accompanying drawings, given by way of example, will enable the invention, the characteristics that it presents and the advantages that it is capable of procuring, to be more readily understood.

DESCRIPTION OF THE PREFERRED EMBODIMENT

Figure 1:
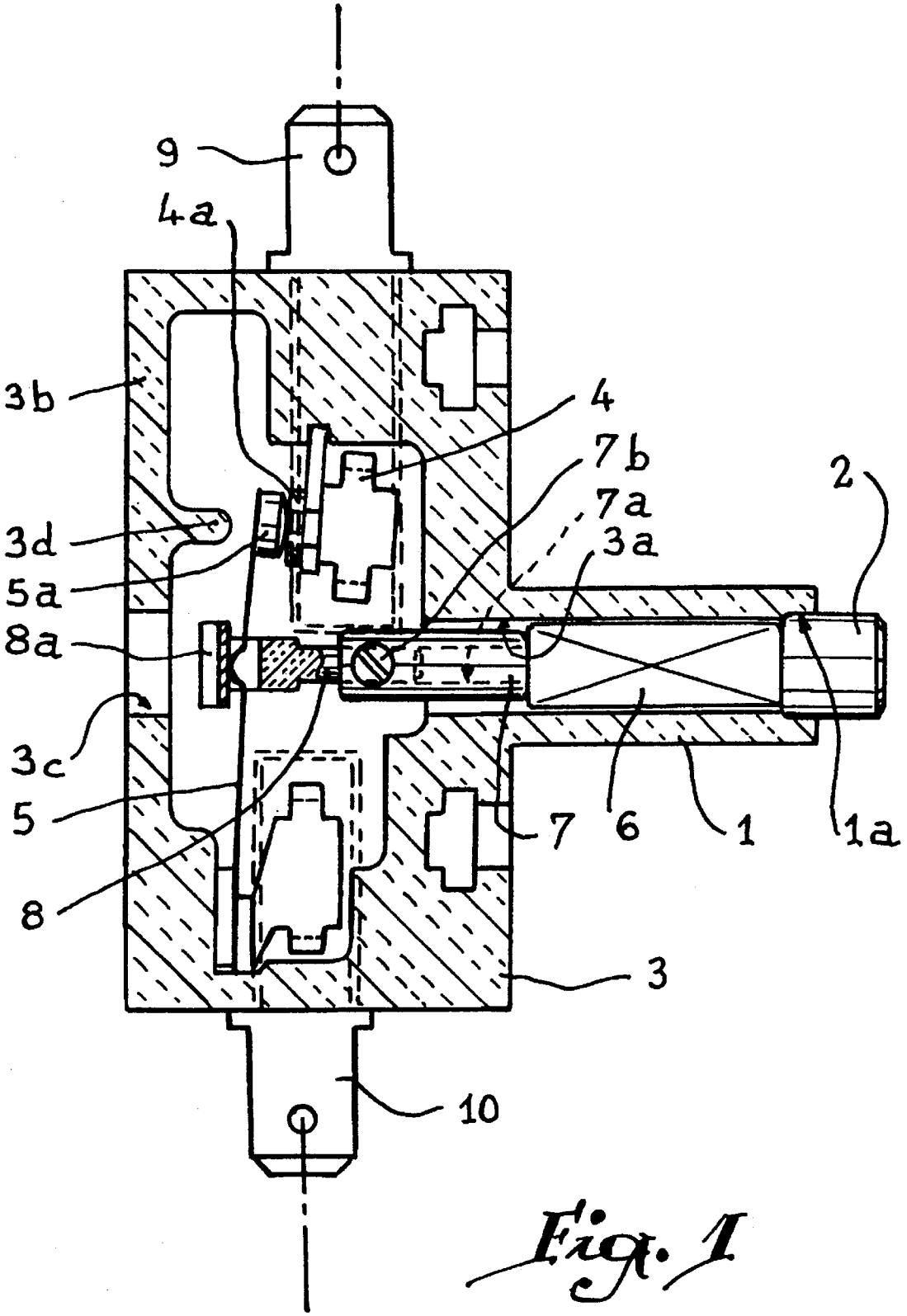
FIG. 1 is a longitudinal section through a temperature limiter according to the invention, in the state of rest.

The high temperature limiter illustrated in FIG. 1 essentially comprises a ceramic tube 1 of which one of the ends is closed by a pellet 2 made of a metal alloy with a determined Curie point, while its opposite end is formed with a box 3 also provided to be made of ceramics. It is observed that the face of the box 3 from which the tube 1 extends comprises a hole **3*a* of which the geometric axis is aligned with that of the tube 1. The box also comprises see a peripheral partition or end wall 3*b* in which is made a hole 3*c* whose geometric axis corresponds to that of hole 3*a* and of tube 1**.

In the box 3 is located a fixed contact **4*a* mounted on a rigid plate 4 and a second contact 5*a* carried by an elastic blade 5 of the spring plate type. A stop 3*d* of the box limits the displacement of the blade 5**, as will be more readily explained hereinbelow.

The pellet 2 made of a metal alloy with determined Curie point is disposed in a recess **1*a* provided at the end of the tube 1. The tube contains a magnet 6 in the form of a solid cylinder and which may freely move longitudinally in the bore of the tube 1. The magnet 6** is of the ALNICO type, i.e. composed of aluminium, nickel and cobalt, for it to be able to function up to temperatures close to 550° C. without losing its magnetic properties.

In hole **3*a*, a plunger 7 made of magnetic material is mounted to slide freely, one of the ends of which is applied against the magnet by welding, adhesion or by magnetism, while its other end includes a smooth bore 7*a* receiving a locking screw 7*b* for locking a rod 8. The latter is provided with a ceramic head 8*a* which engages the spring plate 5. Due to its sliding movement inside the bore 7*a* of plunger 7, rod 8 makes it possible to make an adjustment in length to recover differences in functional clearances incompatible with correct functioning of the limiter. When the adjustments are made, the rod 8 is immobilized via the screw 7***b* inside the bore 7*a* of the plunger 7. It goes without saying that the Curie temperature of the plunger 7 must be higher than that of the pellet 2.

In fact, the use of ceramics for the box 3 and aluminium, nickel, cobalt (ALNICO) for the magnet 6 involves employing a system for compensating the dispersions on the dimension of the parts, which is obtained by adjusting the rod 8 in length due to the poor manufacturing tolerances of the materials used.

Box 3 and magnet 6 are obtained by molding or sintering at high temperature and, due to the materials employed, undergo considerable, uncontrollable shrinkages during cooling.

In this way, adjustment of each limiter is indispensable to guarantee the accuracy of the regulation temperature. In fact, the regulation temperature is a function of the force joining the magnet 6 to the pellet 2 of alloy with determined Curie temperature; now, the value of the latter is inversely proportional to the square of the distance separating them.

It follows for example that, if an air gap appears because of a magnet which is too short or a ceramic housing which is too long with respect to the nominal length allowing regulation to the desired temperature, the limiter will regulate to a temperature lower than that at which it must function.

Figure 2:
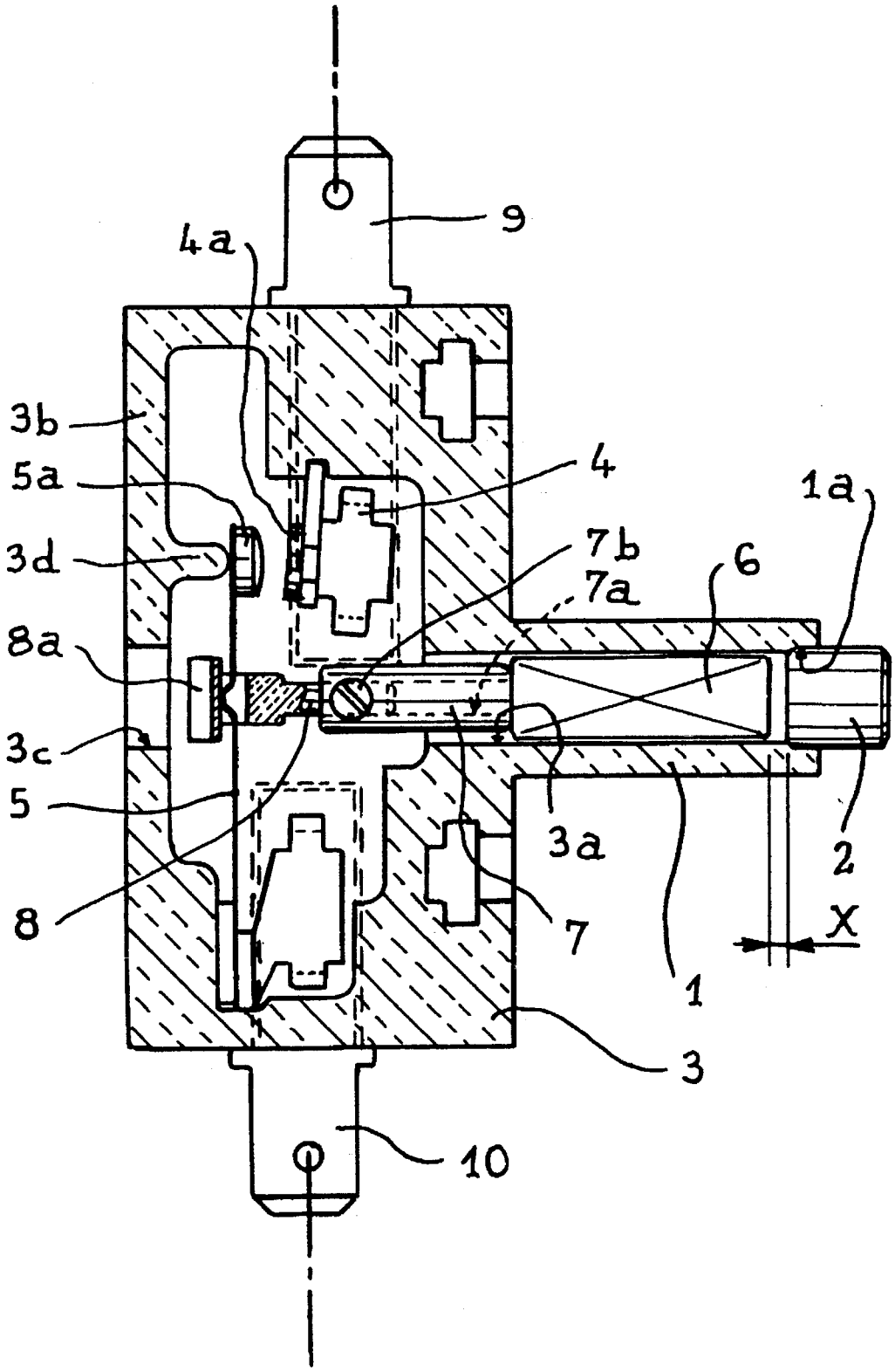
FIG. 2 is a view similar to that of FIG. 1, but showing the limiter in operation, i.e. interrupting the supply circuit of the apparatus protected.

Functioning is as follows:

In the position of FIG. 1, it is possible to switch on the circuit supplying the heating element connected to terminals 9, 10 connected to contacts 4*a* and 5*a* of the plate 4 and the blade 5. The characteristics of the pellet 2 are such that, from a certain temperature, for example 550° C., this pellet is demagnetized, with the result that the magnet 6 is no longer attracted by it. At that moment, the elastic blade 5 becomes preponderant and causes the assembly of the three parts 6, 7, 8 to move towards the left, so that the blade 5 abuts against the stop 3*d* and the contacts 4*a*, 5*a* separate in order to open the circuit. The electrical supply to the apparatus monitored is therefore interrupted. At that moment, a clearance X exists between the magnet 6 and the pellet 2 which is, of course, fixed in translation (FIG. 2).

When the circuit at terminals 9, 10 is cut, the temperature of the apparatus lowers, so that, pellet 2, resuming its qualities of causes magnet 6 to move towards the right in the direction of the pellet over the length of the clearance X. As the plunger 7 is metallic, it is also displaced by the magnet on condition, of course, that the force of magnetic attraction is greater than the force of the elastic blade 5. Under these conditions, the elasticity of the blade 5 participates in the displacement towards the right of magnet 6, and plunger 7, so that contacts 4*a*, 5*a* close again and the position of ( FIG. 1 is resumed.

It will be noted that the elastic blade 5 is stressed, i.e. placed in its deformed position when the magnet 6 is in contact with the pellet 2, while it returns into its rest position when the magnet 6 is no longer attracted by the pellet 2 due to its demagnetization by the increase in the temperature in its vicinity.

It is noted that the blade 5 charged with the elastic return of the magnet 6 and the passage of the current must be made of an alloy of NICKEL-BERYLLIUM type which is the only one to guarantee both excellent mechanical characteristics and a good electrical conductivity.

Figure 3:
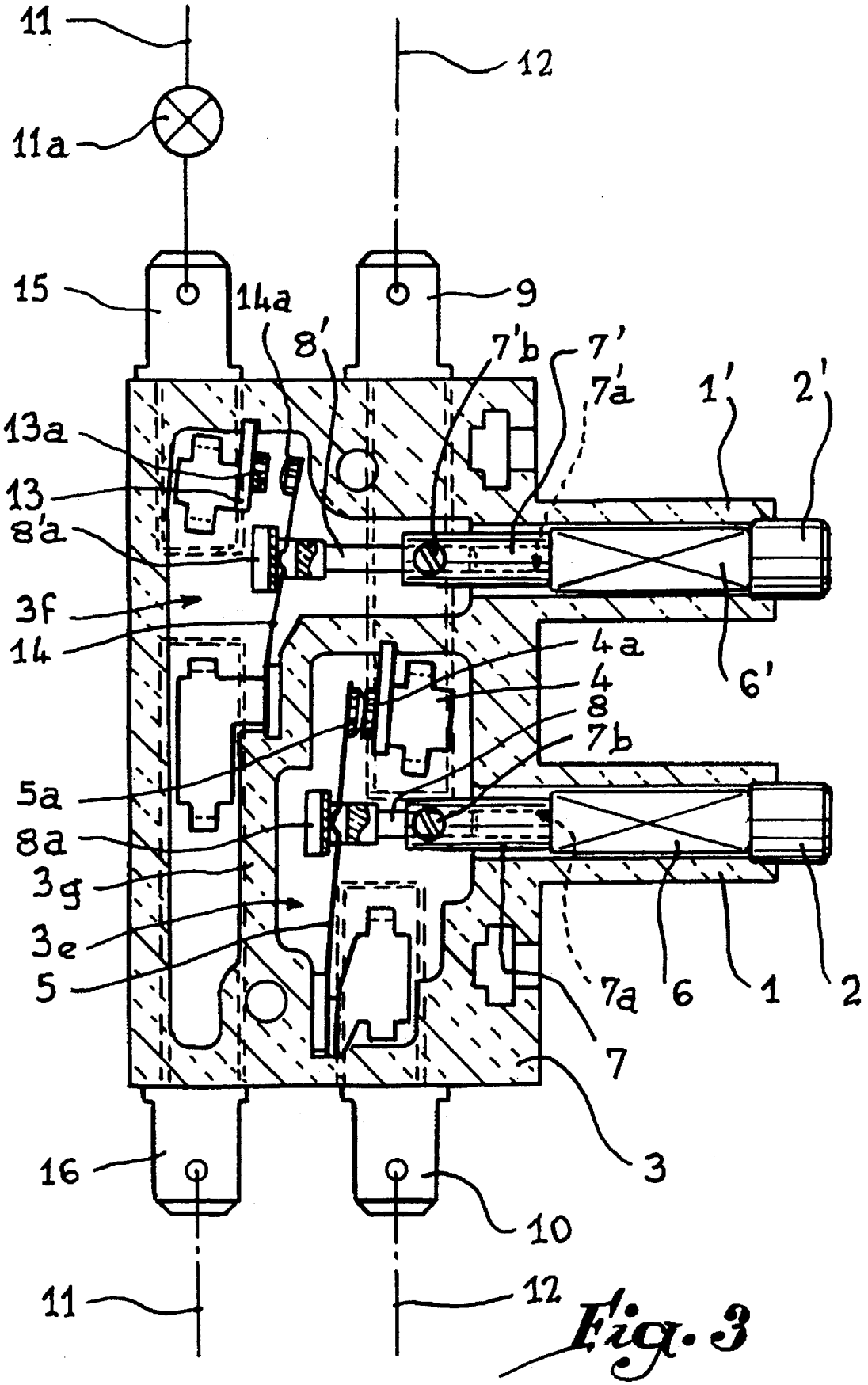
FIG. 3 illustrates a first variation of the limiter of FIG. 1.

FIG. 3 illustrates a varied embodiment of the limiter illustrated in FIGS. 1 and 2. In this Figure, the elements corresponding to those of FIGS. 1 and 2 have been referenced with the same figures and the same indices.

The purpose of the varied illustrated in FIG. 3 consists in further providing means for controlling the opening and closure sure of a signalling circuit 11 so that it is open within the temperature range included between 0° and 50° to 60° C. and closed between these latter temperatures and that of opening of the principal circuit 12 so as, in this latter case, to supply a control lamp 11*a* signalling that the apparatus associated with the limiter in question is still hot.

In accordance with the variant of FIG. 3, the box 3 is provided to receive a second tube 1' parallel and identical to the first, 1, and in which are introduced a pellet 2', a magnet 6', a plunger 7 and a rod 8'. Pellet 2' presents a Curie point corresponding to about 50° to 60° C., different from that of the pellet 2 of the first tube 1.

It goes without saying that the plunger 7' comprises a bore 7'*a* and a screw 7'*b* for adjusting the rod 8' in length. The Curie temperature of the plunger 7' is, in addition, greater than that of the pellet 2'.

In box 3, the shape of the internal partitions is slightly modified to constitute two distinct spaces 3*e*, 3*f* separated by an internal partition 3*g*.

Inside space 3*e* is located the fixed contact 4*a* mounted on a rigid plate 4 and a second contact 5*a* carried by an elastic blade 5 which is connected to plunger 7 via the rod 8. Contacts 4*a* and 5*a* of plate 4 and of blade 5 are connected to the principal supply circuit 12 via the terminals 9 and 10.

Concerning space 3*f*, it contains a rigid tongue 13 whose end comprises a fixed contact 13*a* and a second elastic blade 14 which bears at its free end a movable contact 14*a*.

Tongue 13 is connected to an output terminal 15 and blade 14 to an output terminal 16 from which the signalling circuit 11 is connected.

According to the embodiment of FIG. 3, it is noted that the plungers 7 and 7' are respectively connected to the elastic blades 6 and 14 in accordance with the arrangement shown in FIGS. 1 and 2. In fact, the plungers 7, 7' respectively comprise an adjustable rod 8 and 8' engageable with a hooking or retaining system or head 8*a*, 8'*a* made of ceramics or metal. In this embodiment, the elastic blades 6 and 14 are previously deformed to exert a force of pressure between contacts 4*a* and 5*a*; 13*a* and 14*a*, respectively.

In the position illustrated in FIG. 3, the limiter according to the invention is in the state of rest, i.e. the principal supply circuit 12 of the apparatus associated therewith may be switched on.

If this is the case, there is a rise in the ambient temperature. When about fifty degrees C are attained, pellet 2' ceases to be magnetic, with the result that magnet 6' moves under the effect of the reaction of the elastic blade 14. The displacement of plunger 7' causes that of magnet 6' to move, with the result that contacts 13*a* and 14*a* are applied on to each other. In this position, the signalling circuit 11 is closed, as well as the principal supply circuit 12, with the result that the apparatus may continue to heat. When it attains the temperature fixed for demagnetization of the pellet 2, the blade 5 acts on the magnet 6 to displace it so that contacts 4*a* and 5*a* separate. Under these conditions, the supply circuit is cut.

When the supply of the apparatus is then cut voluntarily by the user, the temperature decreases again, contacts 4*a*, 5*a* close and magnet 6 comes into contact again with pellet 2.

When the temperature attains 50° to 60° C., pellet 2' attracts magnet 6', with the result that plunger 7' is displaced, so that blade 14 is deformed and contacts 13*a* and 14*a* separate.

It will be noted that the limiter described herein-above is called to function at high temperature, i.e. in a medium of 500° C. to 600° C. for tube 1, 1' and 250° C. for box 3 and more particularly the part containing contacts 4*a*, 5*a*, 13*a*, 14*a*, which thus necessitates the choice of very specific materials to resist all the stresses.

It is observed that the limiter is entirely automatic, i.e. without manual resetting like those of the prior art.

It goes without saying that the materials used in the limiter of FIG. 3 are identical to those recommended for that of FIGS. 1 and 2.

I claim:

1. A temperature limiter for controlling the supply of electrical energy to a principal circuit comprising, a box formed of a ceramic material and defining an interior space, a hollow ceramic tube extending from said box and communicating with said interior space, first and second terminals extending from said box, a first contact electrically connected to said first terminal and a second contact carried by an elastic blade electrically connected to said second terminal, said elastic blade being oriented within said interior space and normally exerting a resilient force to open said first and second contacts with respect to one another to thereby terminate electrical energy to the principal circuit, a pellet mounted within said ceramic tube formed of a metallic alloy having a magnetic permeability limited by a first Curie point, a magnet movably mounted within said ceramic tube and formed of a metallic alloy, a plunger means connected to said magnet so as to be movable therewith and formed of a metallic alloy having a magnetic permeability limited by a second Curie point, said plunger means including an adjustment means engageable with said elastic blade for adjusting the spacing between said elastic blade and said magnetic so that said second contact engages said first contact when said magnetic engages said pellet when the temperature of said pellet does not exceed said first Curie point.

2. The temperature limiter of claim 1 in which said plunger means includes an open bore, said adjustment means including a rod slidably disposed within said bore, and a locking means for selectably securing said rod in an adjusted position within said bore.

3. The temperature limiter of claim 2 in which said rod includes a head portion engaging said elastic blade.

4. The temperature limiter of claim 1 in which said magnet is made of an alloy, including aluminum, nickel and cobalt, whereby said magnet maintains its magnetic property at temperatures above said first Curie point.

5. The temperature limiter of claim 1 in which said elastic blade is formed of a nickel-beryllium alloy.

6. The temperature limiter of claim 1 in which said second Curie point is greater than said first Curie point.

7. The temperature limiter of claim 1 in which said rod is formed of a material selected from the group of materials consisting of ceramics and metals.

8. The temperature limiter of claim 1 in which said magnet is secured to said plunger means by welding.

9. The temperature limiter of claim 1 including a second hollow ceramic tube extending from said box and communicating with said interior space, third and fourth terminals extending from said box, a third contact electrically connected to said third terminal and a fourth contact carried by a second elastic blade electrically connected to said fourth terminal, said second elastic blade normally exerting a resilient force to close said third and fourth contacts with respect to one another to thereby provide electrical energy to a signalling circuit connected to said third and fourth terminals, a second pellet mounted within said second ceramic tube and formed of a metallic alloy having a magnetic permeability limited by a third Curie point which is different than said first Curie point, a second magnet movably mounted within said second ceramic tube and formed of a metallic alloy, a second plunger means connected to said second magnet so as to be movable therewith, said second plunger means including a second adjustment means engageable with said second elastic blade for adjusting the spacing between said second elastic blade and said second magnet so that said third contact is spaced from said fourth contact when said second magnet engages said second pellet.

10. The temperature limiter of claim 9 in which said second plunger means includes a hollow bore, a second rod slidably disposed within said bore, and a second locking means for securing said second rod within said bore of said second plunger means.

11. The temperature limiter of claim 10 in which said second rod includes a head which is engageable with said second elastic blade.

12. The temperature limiter of claim 9 in which said third Curie point is at a temperature such that said third and fourth contacts are open between 0° to approximately 50° to 60° and closed at temperatures thereabove.

13. The temperature limiter of claim 12 in which the principal circuit is electrically connected to a cooking element.

14. The temperature limiter of claim 1 in which the principal circuit is electrically connected to a cooking element.

* * * * *